United States Patent [19]

Meroni et al.

[11] Patent Number: 4,651,515

[45] Date of Patent: Mar. 24, 1987

[54] PROCEDURE AND DEVICE TO CHANGE ROVING PACKAGES, WITH AUTOMATIC RE-ATTACHMENT OF THE ROVING ON MACHINES TO SPIN CARDED WOOL

[75] Inventors: Roberto Meroni; Danny Lant, both of Pordenone; Fabio Lancerotto, Milan; Umberto Gerin, Pordenone, all of Italy

[73] Assignee: S. Bigagli & C. SpA, Prato, Italy

[21] Appl. No.: 844,588

[22] Filed: Mar. 27, 1986

[30] Foreign Application Priority Data

Mar. 27, 1985 [IT] Italy ..... 83351 A/85

[51] Int. Cl.[4] ..... D01H 15/00; D01H 9/04; D01H 1/40; D01H 5/28

[52] U.S. Cl. ..... 57/261; 57/90; 57/266; 57/276; 57/278; 57/331

[58] Field of Search ..... 57/90, 261, 262, 266, 57/267, 276, 278, 331

[56] References Cited

U.S. PATENT DOCUMENTS

| | | | |
|---|---|---|---|
| 869,044 | 10/1907 | Arnold-Forster | 57/267 |
| 3,173,239 | 3/1965 | Ortmans | 57/266 |
| 3,385,045 | 5/1968 | Slowiak | 57/331 X |
| 4,434,612 | 3/1984 | Petracchi et al. | 57/331 |
| 4,473,997 | 10/1984 | Kawasaki et al. | 57/266 X |
| 4,539,803 | 9/1985 | Ferro et al. | 57/266 X |

*Primary Examiner*—John Petrakes

*Attorney, Agent, or Firm*—Wegner & Bretschneider

[57] ABSTRACT

A process for replacing spent roving packages with new roving packages, with automatic splicing and reattachment of the rovings, on machines to spin carded wool is disclosed. The new roving package is removed from a conveyor and brought to a waiting position, where the end of the new roving is manually placed in a gripper. When the old roving package is almost exhausted, the spindle of the spinning machine is stopped and the roving is sheared. The end of the roving still attached to the spinning machine is retained with an aspirator. The new roving package is then brought to the working position, causing the automatic discharge of the spent roving package, and the gripper brings the new roving to the aspiration site causing the intermingling of the fibers of the two rovings. The spindles are restarted and the spliced segments of the roving receives a false twist and subsequent real twists. The process may be carried out with a device which can remove the new package from the conveyor and bring it to the waiting position and the working position, which also has a gripper to bring the new roving the aspirator site.

24 Claims, 10 Drawing Figures

PROCEDURE AND DEVICE TO CHANGE ROVING PACKAGES, WITH AUTOMATIC RE-ATTACHMENT OF THE ROVING ON MACHINES TO SPIN CARDED WOOL

This invention concerns a procedure to change roving packages simultaneously, with automatic re-attachment of the roving on machines to spin carded wool. To be more exact, the invention concerns a procedure to carry out the simultaneous automatic exchange of roving packages fed to a machine to spin carded wool, the empty tubes being withdrawn at the same time.

The invention provides also for the automatic re-attachment of the roving at each spinning unit and the shearing of the roving currently being processed so that the almost empty packages can be discharged.

The invention concerns also a device that carries out such procedure.

Many patents are known which concern the replacement of textile packages such as roving packages, bobbins, etc. for supply to spinning machines.

For instance, patent GB-A-2,094,359 discloses a device to detect a missing supply roving and to replace bobbins in positions where the roving is missing owing to exhaustion of the bobbin or breakage of the roving. This device comprises a trolley that patrols along the spinning machine and is equipped with means able to detect the lack of roving supply. The trolley includes means able to withdraw the exhausted bobbin or bobbins with broken roving and to replace them with a full bobbin or bobbins and reattach the roving supply. Such device can replace only one bobbin at a time, the replacement taking place only at the spinning unit affected on each occasion by breakage of roving or exhaustion of the bobbin.

Patent BE-A-698218 is known and discloses a device specifically intended to unwind and separate rovings when roving packages are exchanged on spinning machines. This device contains roving packages in a reserve position, with the roving pre-arranged in means able to take it to correspond with the roving being processed and to perform splicing of the two rovings. The packages in the reserve position do not take the place of the packages being processed but are unwound in their reserve position by an unwinding roll. This device entails, therefore, problems for the operator to take corrective action if the roving breaks.

Patent DE-A-2.521.851 discloses a device to change the cans for open-end spinning machines, the device comprising trolleys to support and move the cans; a device to shear the roving being processed is included in correspondence with the spinning units.

According to the known art the roving packages of carded wool are fed to a spinning machine on a conveyor. They are then positioned by hand on appropriate supports for unwinding.

The roving from each package is fed into the machine by hand; the machine operative takes the roving, passes it between the feed rolls and splices the ends of the new roving with the roving currently being processed by rubbing them together into a cylindrical formation and winding them about each other.

A purpose of this invention is to enable these operations, which have been performed by hand hitherto, to be carried out automatically. According to the invention the machine operative will have only the task of checking the degree of unwinding the package, positioning the rovings in appropriate grippers, and permitting a cycle of simultaneous automatic exchange of all the packages and re-attachment of the respective rovings to begin.

Such permission may possibly be given automatically if an automatic detector is provided to monitor the degree of emptiness of the roving packages currently being processed and the correct positioning of the roving packages hung on the delivery conveyor.

This invention provides an arm able to take full roving packages from a conveyor preferably located along and above a spinning machine. Such arm takes the full roving packages and places them on an appropriate support so as to be unwound in cooperation with an unwinding roll. The exhausted packages are discharged from the support onto an appropriate conveyor at the same time as a new roving package is inserted. These operations are performed simultaneously for all the spinning units.

In a preferred embodiment, means are provided to take the roving of the new packages and superimpose it on the roving of the packages currently being processed, the latter roving being cut and then kept engaged by pneumatic or mechanical means.

In a preferred embodiment, the ends of the rovings are placed, superimposed one on the other, on an appropriate aspiration grill, which not only has the task of retaining such ends but also imparts to the fibers of the two rovings a certain degree of mutual intermingling by friction between the fibers, such intermingling being able to provide a drawing effect as far as the outlet from the feed rolls, which by compressing the fibers contribute to an increase in the union of the rovings. At the outlet from the feed rolls the roving and the splice obtain a false twist imparted to them by a device which contributes towards providing the splice with strength. The final union is performed at the moment when the fibres acquire their final twist through the normal spinning system.

Scissors of a type known in the art cut simultaneously the roving coming from the rovings packages currently being processed.

According to the invention the roving packages are exchanged preferably with the ring rails halted at top dead center. In this way, after the roving coming to an end and the roving being put into work have been spliced, the bobbin of the spinning machine is connected up and the splice becomes positioned in the underwinding, which is eliminated later in the subsequent operations even if the type of splice thus obtained does not create any problems during weaving. In this way there will be no trace of the splice in the completed yarn packages.

However, as an alternative the splice can be performed with the carriage in any position if it is not desired to eliminate the splice. In this case the splice will remain in the yarn package.

According to the invention, at the beginning of the automatic exchange cycle, all the roving packages have to be positioned on their conveyor at the position from which they are to be taken. The machine operative can then actuate the push button or control which starts the cycle.

This invention is therefore obtained with a procedure to change roving packages simultaneously, with automatic re-attachment of the roving on machines to spin carded wool, the roving packages being delivered by a conveyor, the procedure being characterised in that it comprises:

a cycle for positioning the roving packages on stationary stations coinciding with the spinning units by taking them from the conveyor, transferring them to a position for engagement of the rovings and positioning the new rovings by hand, and an automatic cycle for simultaneous exchange of roving packages with at least the following steps:

halting the spindles, retaining the rovings currently being processed and shearing the same, transferring the new roving packages to a working position, discharging the exhausted roving packages, transferring the new rovings and superimposing them on the remaining portions of the rovings currently being processed, intermingling the fibres of the two rovings, both that being processed and the new one, at least partially at each spinning unit, starting up the spindles, imparting a false twist to the spliced segments of the rovings, and imparting real twists to each spliced roving by means of the spindle, it being possible for such steps to overlap one another in time at least partially.

The invention is also embodied with a device to change roving packages, with automatic re-attachment of the roving on machines to spin carded wool, the device comprising a conveyor to bear roving packages with forked supports, means to support roving packages momentarily, means to discharge package support rods, means to shear rovings, and means to impart false twist, which device is characterised in that it includes:

means able to engage roving packages and take simultaneously the new roving packages relative to the various spinning units from the conveyor and place them on means to bear roving packages momentarily, means to engage momentarily the rovings coming from new roving packages, and means which retain momentarily the rovings currently being processed and cooperate with the means that shear the rovings, the means that engage the new rovings momentarily being capable of bringing such new rovings into contact with the corresponding rovings currently being processed and retained by such momentarily retaining means.

We shall now describe a preferred embodiment of the invention as a non-restrictive example with the help of the attached figures, in which:

FIG. 1 is an overall side view of a desired cross section of a spinning machine for carded wool, a device according to the invention being fitted to such machine;

FIG. 2 gives a detail of a doffing device in a three-dimensional view;

FIGS. 3 and 4 show a detail of an arm which takes and places roving packages, together with means that unwind such packages partially;

FIG. 5 gives a detail of the engagement of the roving by an aspiration intake and also of scissors that shear the roving;

FIG. 6 shows a view from above of the scissors that shear the roving;

FIGS. 7*a* and 7*b* give a view from above of the engagement of the new roving by the aspiration intake;

In the figures the same parts or parts having the same functions bear the same reference numbers.

Figure 1:
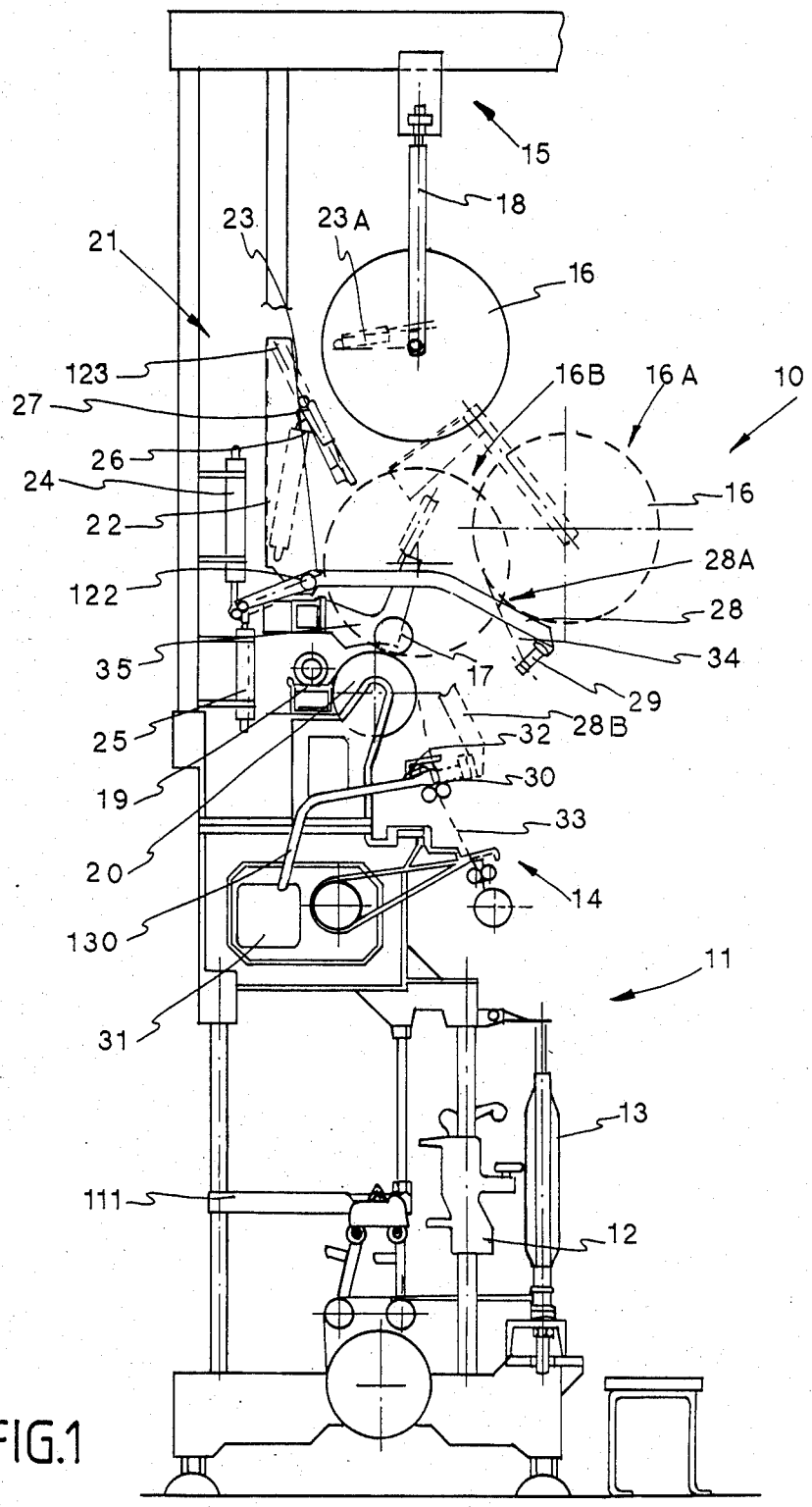

In FIG. 1 a device 10 to doff roving packages is fitted to a spinning machine 11. A frame of the machine is referenced with 111, whereas 12 is a ring carriage able to move vertically with alternating motion to form a yarn package on a bobbin 13.

A false twist device 14, which in itself is known, is disposed above the spinning machine 11 and is actuated in a known manner; this device 14 is already included in the spinning machine and is employed to contribute towards formation of the splice between the old and new rovings, as we shall see later.

A conveyor 15 to deliver roving packages 16, which are supported by forked supports 18 for instance, is comprised in a known manner above the spinning machine 11.

Hereinafter we shall refer to only one of the roving packages as the elements of the device and the operating steps are the same for all the roving packages arranged along the spinning machine.

An empty package support rod 17 and a conveyor 19 to remove empty rods from the spinning machine 11 are included.

Figure 2:
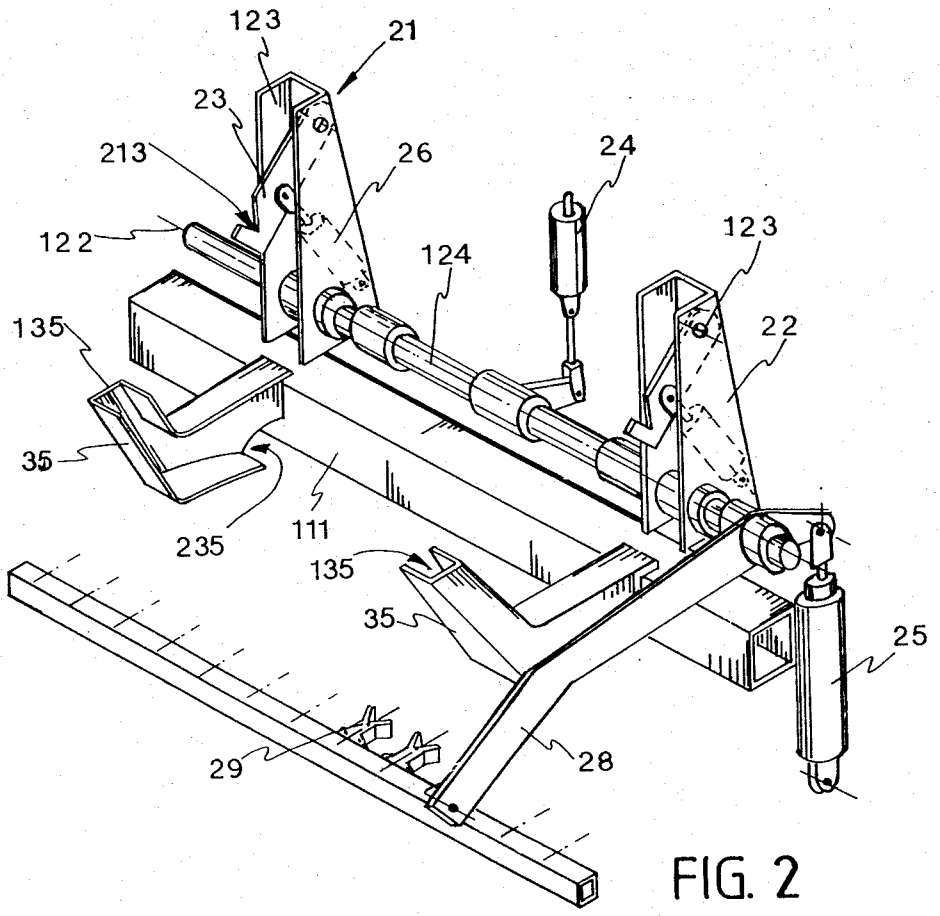
Figure 7A:
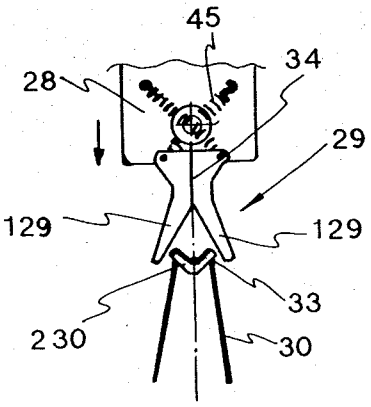
Figure 7B:
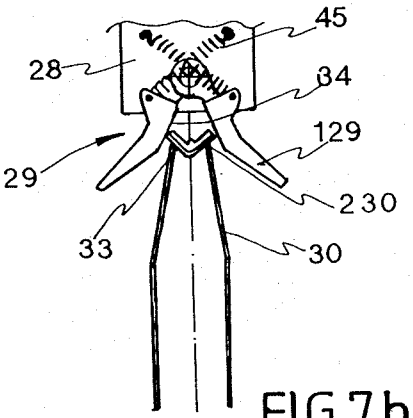

A drafting roll 20 causes unwinding of the roving package in the working position of the latter on package supports or guides 35 (see also FIG. 2).

The device 10 comprises essentially an articulated arm 21 able to take the roving package 16 from its support 18 on the conveyor 15 and to bring it to a waiting position 16A and an unwinding position 16B.

When the package 16 is brought from position 16A to position 16B, it causes by direct action the discharge of the support rod 17 supported on the guide 35. Such rod 17 drops and is removed on the conveyor 19.

The device 10 includes also an arm 28 bearing a gripper 29 at its end; such arm 28 is normally located at position 28A in FIG. 1.

In the embodiment shown, as soon as the roving package 16 has been brought above the spinning machine 11 by the conveyor 15, the machine operative starts a cycle in which the articulated arm 21 takes the roving package 16 from the conveyor 15 and positions it at 16A.

She then positions the new roving 34 of the package 16 in grippers 29 by hand. The package 16 is rotated by hand for the end of the roving to be engaged.

With the cycle started, the package 16 is taken from 16A to 16B and the arm 28 is lowered automatically to position 28B at the same time. Here an aspiration intake 30 with a grill 230 receives the new roving 34. In the embodiment shown such intake 30 has already engaged the roving 33 currently being processed, on the surface of the grill 230.

The aspiration action of the intake 30 is carried out by means of a pipe 130 cooperating with an aspiration duct 31 running along the spinning machine 11. Such aspiration action causes a certain intermingling of the fibers of the two rovings 33–34, as we said earlier. This is made possible owing to the fact that the grill 230 acts as a support surface for the two rovings 33–34. A pair of scissors 32 serves to cut the roving 33 currently being processed.

FIG. 2 shows the structure of the upper part of the device 10 in greater detail. A pair of arms 22 can be seen on a shaft 124 driven by an actuator 24. Lever arms 23, pivoted at 123 on the arms 22, are driven by actuators 26.

By means of the articulated arm 21 it is possible, as can be seen in FIG. 1, to actuate engagement of the roving packages 16 and to transfer the same onto guides 35. The latter consist substantially of channel sections, made of steel plate for instance, with an inlet 135 and outlet 235.

Figure 4:
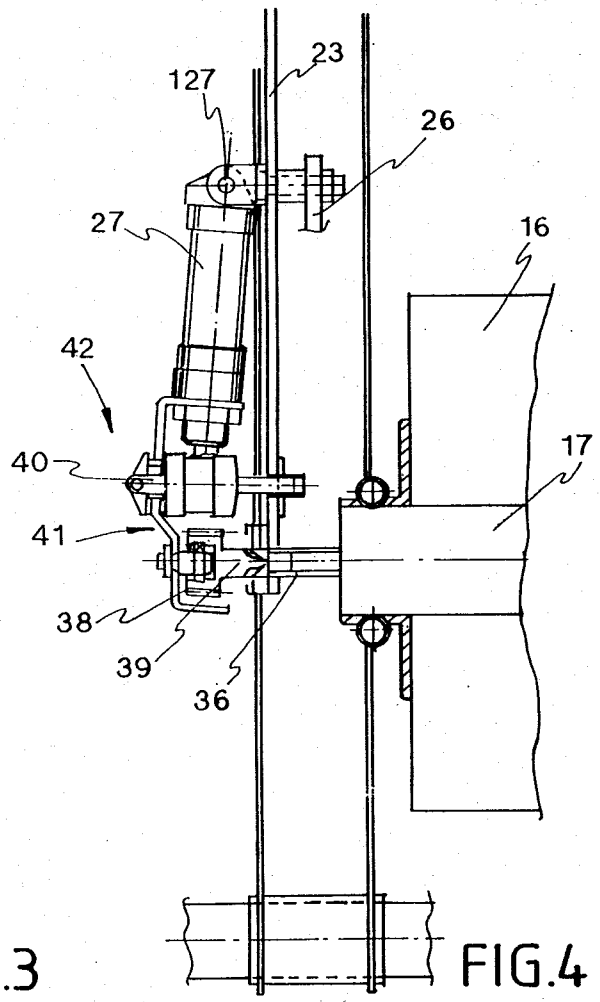

As can be seen better in FIG. 4 for instance, the ends 36 of the support rod 17 of the roving package 16 are inserted into the C-shaped profile of the guides 35.

Figure 3:
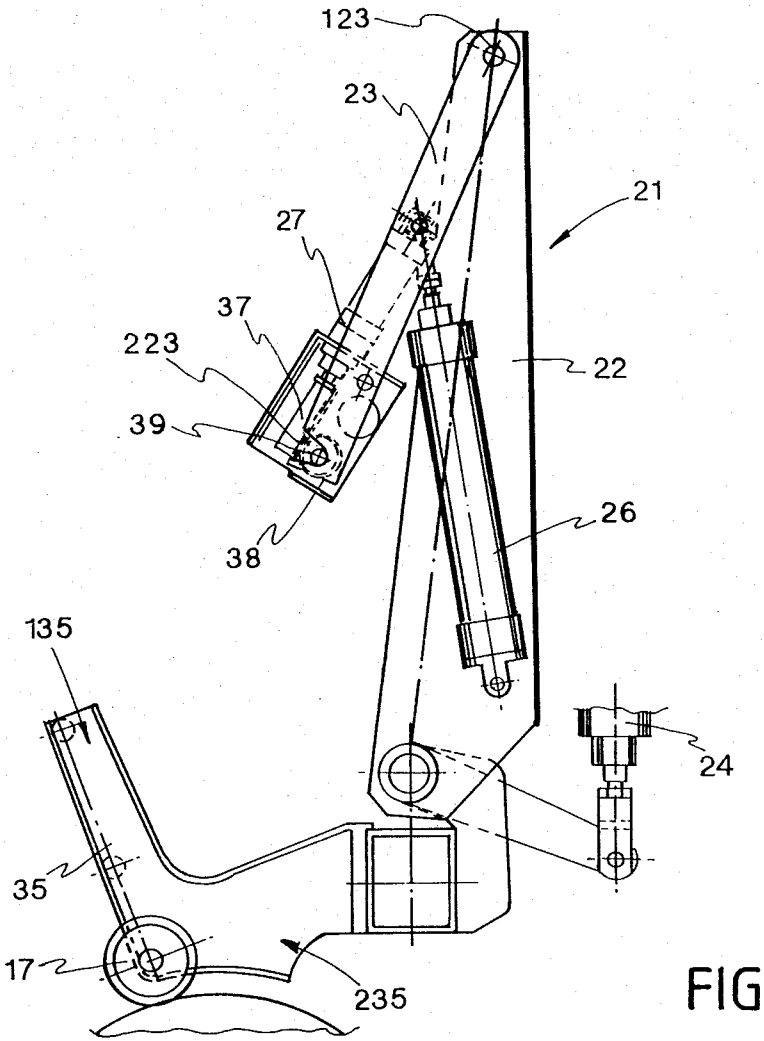

In the embodiment shown in FIGS. 3 and 4, means 42 are included to clamp the roving packages 16 axially and to impart a rotation thereto at the beginning of the cycle so as to facilitate the unwinding of the new roving 34 without the latter becoming broken.

Such means 42, therefore, serve to enable a given quantity of roving to be unwound during lowering of the arm 28 bearing the end of the roving in the grippers 29, and also to enable the lever arm 23 to be displaced at the same time.

In the example shown the means 42 include an actuator 27 with a rack 37. Such rack acts on a toothed wheel 38, which bears a cross-shaped headstock 39 able to engage the end 36 of the support rod 17.

The actuator 27 bears a support element 41 on which the toothed wheel 38 is pivoted. At the end of the support element 41 is an actuator 40 consisting of a pneumatic cylinder solidly fixed to the other end of the lever arm 23.

This makes it possible to rotate the actuator 27-support element 41-wheel 38-headstock 39 assemblage about a pivot 127 so as to engage or disengage the pivot end 36 of the support rod 17.

Figure 5:
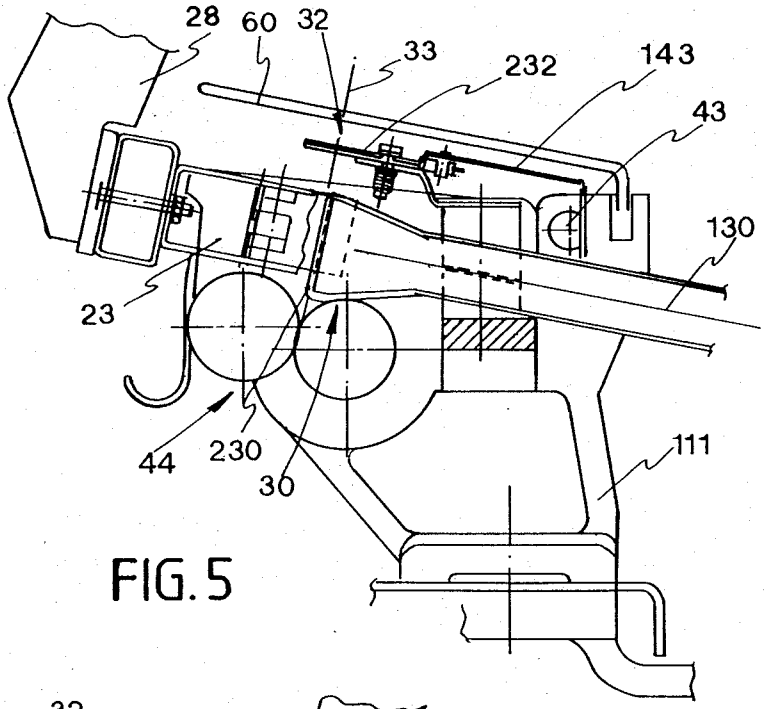
Figure 6:
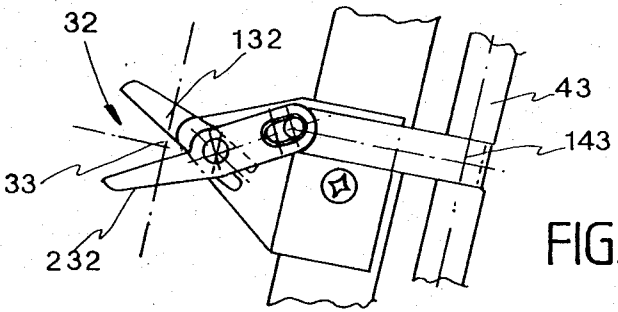

FIG. 5 shows a detail of the delivery of the new roving 34 by the arm 28 with the gripper 29 to the aspiration intake 30. It is possible to see the roving currently being processed 33 engaged in the intake 30 and in a drafting unit 44 consisting of a pair of rolls.

Such roving 33 passes through a thread-guide 60 and between a stationary blade 132 and movable blade 232 of the scissors 32. The movable blade 232 is operated through a transmission 143 by an actuation bar 43, which actuates all the scissors serving the various spinning units.

The arm 28 is shown in the position where it delivers the new roving 34 to the aspiration intake 30.

It is possible to see in FIGS. *7a* to *7b* too the delivery of the new roving 34 to the intake 30, on the grill 230 of which the roving 33 currently being processed is already engaged.

The arm 28 moves towards the intake 30 in the direction of the arrow of FIG. *7a*. The end of the intake 30 causes the opening of the grippers 129, which are kept open by a spring 45 having two stable positions.

The new roving 34 is caught by the intake 30, and the aspiration action at the surface of the grill 230 produces a first mutual penetration of the fibers of the new and current rovings 33–34.

Figure 8:
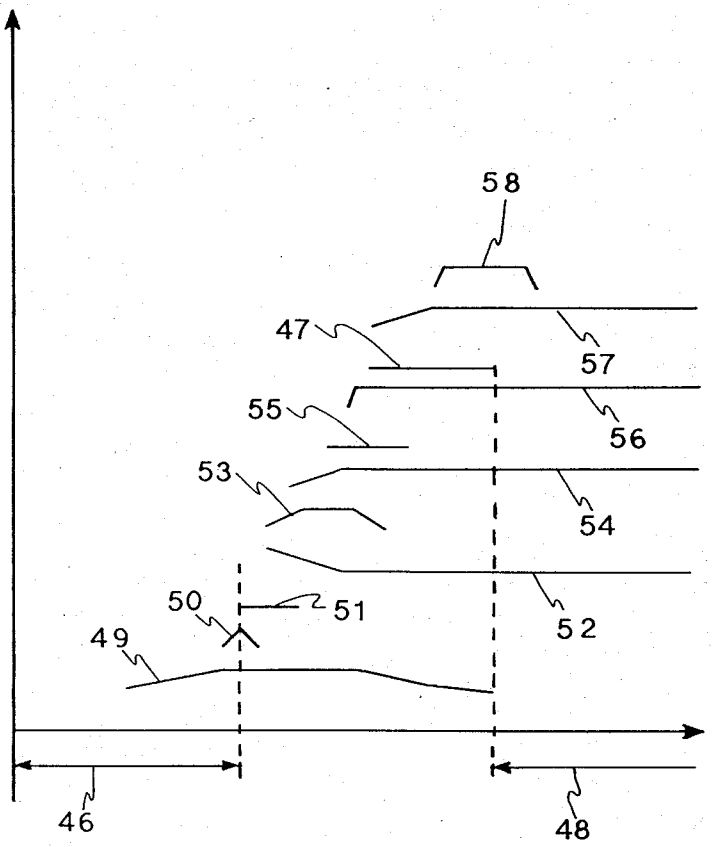
FIG. 8 shows the steps of a preferred cycle for changing roving packages.

Let us now see a preferred cycle of the exchange of roving packages according to FIG. 8. In a preferred cycle the machine operative first of all sets in motion a package pre-arrangement cycle, which takes place when the roving packages 16 are in a suitable position above their respective spinning units, that is to say, a position which enables the packages to be engaged by the articulated arm 21.

The actuator 26 moves the secondary arm 23 to its raised position 23A of FIG. 1 for engagement of the roving package 16. The secondary arm 23 takes the package 16 from the conveyor 15 by means of terminal engagement hooks 223 cooperating with the pivot ends 36 of the support rod 17. The articulated arm 21 is then lowered by the actuator 24 until it has brought the package 16 to position 16A.

The cycle of pre-arrangement of the machine now ends and the machine operative acts by hand to position the new rovings 34, the package 16 being freely rotatable for engagement of the end of the new roving 34.

The machine operative positions the new rovings 34 coming from the packages 16 at position 16A between the grippers 29 of the arm 28 in its position 28A; she then actuates closure of the headstocks 39 by means of the actuator 40 by using the push button. The grippers 29 are now kept closed by the action of the springs 45 having two stable positions.

the real cycle for exchanging the roving packages 16, as shown in FIG. 8, then begins. First of all the spindles are halted (step 46) and the aspiration is started (step 49) through the duct 31.

The aspiration action at the intake 30 aspirates and engages on the grill 230 the roving 33 currently being processed. The scissors are actuated (step 50 of FIG. 8) and the current roving 33 is sheared.

The current roving 33 is now engaged only by the drafting unit 44 and aspiration intake 30.

During this movement the rotation of the drafting roll 20 is inverted (step 51) so as to enable the segment of sheared roving not engaged by the aspiration intake 30 to be re-wound on the rod of the current roving package 33, and also so as to assist the discharge of such rod 17 with its remaining roving.

The headstocks 39 are now rotated (step 53), and the arm 28 is lowered (step 54), taking with it the roving 34 of the new package engaged in the gripper 29.

The return movement of the secondary arm 23 (step 52) almost at the same time as the previous step brings the new roving package 16 from position 16A to position 16B. Towards the end of this travel the new package 16 presses against the support rod 17, which is thus discharged through the outlets 235 of the guides 35. The rod 17 falls onto the conveyor 19 (step 55 of FIG. 8) and is removed.

Figure 9:
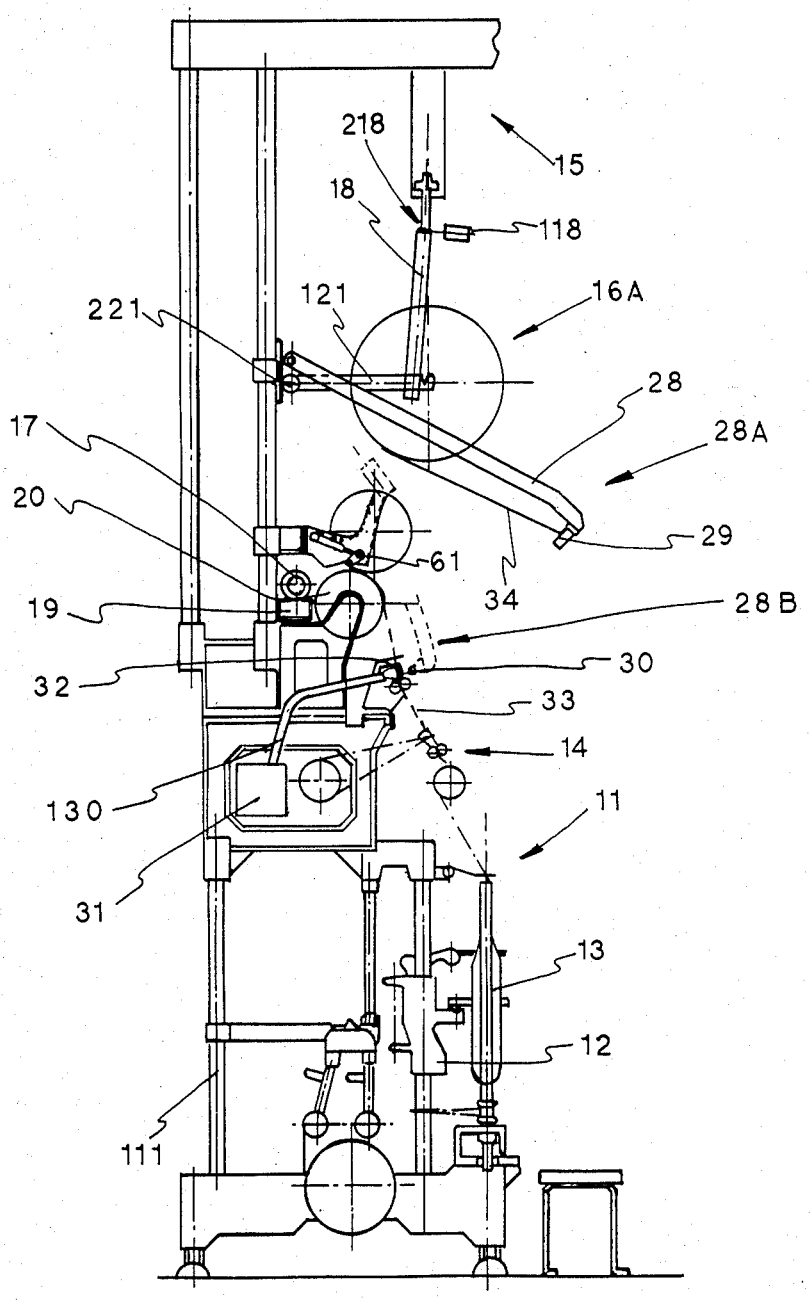
FIG. 9 shows a variant of the invention.

In a variant shown in FIG. 9 the rod 17 can be discharged by a mechanical thruster 61, such as a lever or the like, rather than by the new roving package 16.

The headstocks 39 are opened immediately after the beginning of discharge of the support rod 17 so as to enable the new package 16 to fall into the appropriate guides 35 (step 56).

Splicing takes place on the grill 230 of the aspiration intake by means of a first intermingling of the fibers when the new 34 and old 33 rovings are brought into contact with each other, as shown in FIGS. *7a* and *7b*, for instance.

The working of the machine is then re-started (step 47) and the ring carriage 12 is therefore lowered (step 58).

The splice is perfected by passing through the drafting unit 44 and then receiving false twists from the false twist device 14; thereafter it obtains the real twists by passing through the drafting unit. Thus the bobbin 33 is connected up and the splice descends into the underwinding, which will be eliminated, as is known.

However, as we said earlier, the splice can be made while normal working proceeds, and in this way the splice will remain on the bobbin of yarn.

In fact, the splice which can be made according to the invention is very slender and homogeneous and does not entail problems in the subsequent processes. It can therefore also remain on the bobbin.

In the meanwhile the main arm 22 is moved back to the position shown with full lines in FIG. 1 (step 57).

During its descent the splice receives a false twist, as we said earlier, from the false twist device 14, and in this way the new 34 and old 33 rovings are firmly united, accidental breakage being thus prevented.

The final union of the two rovings 33–34 takes place when their segments involved in the splice obtain from the ring and from the rotation of the spindle the real twists which characterize the product.

The fuses (step 48) thereafter are halted again and doffing is carried out by any required method.

FIG. 9 shows a variant of the invention in which a rigid arm 121 is comprised instead of the articulated arm 21 of FIG. 1. This rigid arm 121 takes the roving package 16 from the forked support 18 by being lifted until it engages the ends of the support rod of the roving package 16 and raises such ends from the terminal hooks of the forked support 18.

In this variant the forked support 18 comprises an articulated joint 218 and, as soon as it is freed of the roving package 16, rotates slightly owing to the effect of a counterweight 118 or analogous return means, such as a return spring or the like. In this way the ends of the forked support 18 can no longer engage the package 16.

The roving 34 is positioned on the gripper 29. Since the engagement position of the package 16A is higher than that in the embodiment of FIG. 1, a raised gangway or other analogous means may be provided for the machine operative so as to enable her to position the roving 34 in the gripper 29 by hand in an easy manner.

The new roving package is put within the support guides 35 be mere clockwise rotation of the rigid arm 121.

In the example shown the rod 17 or exhausted roving package is discharged by means of a lever 61 actuated by a pneumatic cylinder. The working cycle is analogous to that described earlier.

We have described here a preferred embodiment of this invention but variants are possible without departing thereby from the scope of the invention.

Thus the shapes and proportions of the parts can be changed and it is possible to employ mechanical equivalents of the arms 22–23 and of the headstocks 39 and also mechanical equivalents of the actuators 24–27; it is also possible to employ pneumatic aspiration means instead of the grippers 29 to engage the new roving 34; it is also possible to alter the duration and momentary overlapping of the various steps in the cycle for exchanging the roving packages 16. These and other variants are all possible without departing thereby from the scope of the invention.

We claim:

1. A process for simultaneously changing roving packages, and automatically reattaching the roving, on a machine to spin carded wool having a spindle, comprising the following steps:

(a) conveying a new roving package to the machine on a conveyor;

(b) a preparatory cycle for positioning a new roving package, comprising the steps of:

removing the new roving package from the conveyor;

transferring the new roving package to a stationary engagement position; and positioning the new roving in a gripper; and (c) an automatic cycle for simultaneous exchange of the roving packages comprising the following steps:

halting the spindle;

retaining the roving of an exhausted roving package on the spindle of the machine;

shearing the roving of the exhausted roving package;

transferring the new roving package to a working position;

discharging the exhausted roving package;

transferring the new roving, and superimposing the new roving on the retained portion of the exhausted roving package;

intermingling the fibers of the new roving and the roving of the exhausted roving packages to form a spliced segment between the new and exhausted rovings;

restarting the spindle;

imparting a false twist to the spliced roving segment; and imparting a real twist to the spliced roving segment at the spindle.

2. The process as claimed in claim 1, wherein said preparatory cycle is started by manual control.

3. The process as claimed in claim 1, wherein said preparatory cycle is started automatically, the ability to start said preparatory cycle being controlled by the degree of exhaustion of the roving package currently being processed.

4. The process as claimed in claim 1, wherein the roving of the exhausted roving package is retained pneumatically.

5. The process as claimed in claim 1, wherein the roving of the exhausted roving package is retained mechanically.

6. The process as claimed in claim 1, wherein said new roving package is rotated during said step for transferring the new roving package, so as to assist the unwinding of the new roving package.

7. The process as claimed in claim 1, wherein said exhausted roving package is discharged by the direct action of the new roving package moving to its working position.

8. The process as claimed in claim 1, wherein said step for discharging the exhausted roving packages is actuated independently.

9. The process as claimed in claim 1, wherein at least partial intermingling of the fibers of the new rovings and the rovings of the exhausted roving packages takes place pneumatically.

10. The process as claimed in claim 1, wherein said splice between the two rovings is transferred into an underwinding for subsequent elimination.

11. The process as claimed in claim 1, in which said splice between the two rovings is transferred onto a bobbin of yarn.

12. A device to change roving packages having a support rod, and automatically re-attach the roving on a machine to spin carded wool comprising:

a conveyor having a support to bear a new roving package;

a first removal means to remove a support rod of a spent roving package;

support means to support a current roving package while it is being used by said spinning machine;

a second removal means to remove the new roving package from said conveyor and place it on said support means;

shearing means to shear the roving of the current roving package;

a means to impart a false twist to the current roving;

retaining means to momentarily retain the roving of the current roving package; and engagement means to engage the roving of the new roving package and bring the new roving into contact with the current roving being retained at said retaining means.

13. A device as claimed in claim 12, wherein said second removal means comprises at least one movable arm rotatably attached to the spinning machine.

14. A device as claimed in claim 13, wherein said second removal means comprises a first arm rotatably attached to the spinning machine, and a second arm rotatably attached to said first arm.

15. A device as claimed in claim 14, wherein said second arm comprises a hook to engage the ends of the support rod of said new roving package.

16. A device as claimed in claim 12, wherein said second removal means comprises at least one powered headstock to engage the support rod of the new roving package to aid in the initial unwinding of the new roving package.

17. A device as claimed in claim 12, wherein said support means comprises an inlet for accepting the new roving packages and an outlet for discharging of the support rod of a spent roving package.

18. A device as claimed in claim 12, wherein said engagement means comprises at least one movable arm rotatably attached to the spinning machine.

19. A device as claimed in claim 12, wherein said engagement means comprises a gripper to grip the new roving.

20. A device as claimed in claim 19, wherein said gripper is kept open or closed by springs, said gripper having two stable positions.

21. A device as claimed in claim 12, wherein said retaining means comprises at least one aspiration intake.

22. A device as claimed in claim 21, wherein said aspiration intake comprises a grill to support the current roving and the new roving, thereby causing at least partial intermingling of the fibers of the current roving and the new roving.

23. A device as claimed in claim 12, further comprising a means to discharge the support rod of a spent package from said support means to said support rod removing means.

24. A device as claimed in claim 12, wherein said support is forked and articulated, and comprises a return means.

* * * * *